US012533543B2

(12) United States Patent
Mccarthy et al.

(10) Patent No.: US 12,533,543 B2
(45) Date of Patent: Jan. 27, 2026

(54) RUCK PLATE

(71) Applicant: GORUCK Holdings, LLC, Jacksonville Beach, FL (US)

(72) Inventors: Jason J. Mccarthy, Atlantic Beach, FL (US); Courtney Lee, Jacksonville, FL (US)

(73) Assignee: Goruck Holdings, LLC, Jacksonville Beach, FL (US)

( * ) Notice: Subject to any disclaimer, the term of this patent is extended or adjusted under 35 U.S.C. 154(b) by 188 days.

(21) Appl. No.: 18/431,320

(22) Filed: Feb. 2, 2024

(65) Prior Publication Data

US 2025/0249305 A1 Aug. 7, 2025

(51) Int. Cl.
*A63B 21/072* (2006.01)

(52) U.S. Cl.
CPC ..... *A63B 21/072* (2013.01)

(58) Field of Classification Search
CPC ..... A45F 3/00; A45F 3/04; A45F 3/06; A63B 21/065; A63B 21/072; A63B 21/4007; A63B 21/4039
See application file for complete search history.

(56) References Cited

U.S. PATENT DOCUMENTS

| | | | | | |
|---|---|---|---|---|---|
| 3,771,785 | A * | 11/1973 | Speyer | A63B 21/0728 | 403/375 |
| 4,880,229 | A * | 11/1989 | Broussard | A63B 21/0724 | 482/106 |
| 4,905,993 | A * | 3/1990 | Barone | A61F 5/028 | 482/106 |
| 5,267,931 | A * | 12/1993 | Faetini | A63B 23/0211 | 602/18 |
| 6,736,765 | B2 * | 5/2004 | Wallace | A63B 21/072 | 482/106 |
| 8,926,481 | B2 * | 1/2015 | Moore | A63B 21/0724 | 482/94 |
| 8,998,778 | B2 * | 4/2015 | Potts | A63B 21/0724 | 482/106 |
| 9,844,694 | B2 * | 12/2017 | Birt | A63B 23/1209 | |
| 11,097,147 | B2 * | 8/2021 | Jones | A63B 21/0607 | |
| 12,296,218 | B2 * | 5/2025 | Petek | A63B 21/075 | |
| 2019/0388723 | A1 * | 12/2019 | Nalley | A63B 21/0604 | |
| 2023/0211200 | A1 * | 7/2023 | Westbrook | A63B 21/072 | 482/93 |
| 2023/0271048 | A1 * | 8/2023 | Dao | A63B 21/065 | 482/92 |

* cited by examiner

*Primary Examiner* — Joshua Lee
(74) *Attorney, Agent, or Firm* — Offit Kurman; Tod A. Kupstas

(57) ABSTRACT

A ruck plate for accommodating the anatomy of a person's back. The ruck plate has a depression formed in the back surface that is adapted to accommodate the spinal column and mitigate potential problems caused by activity while exercising with the ruck plate.

14 Claims, 6 Drawing Sheets

RUCK PLATE

TECHNICAL FIELD

The present disclosure relates to ruck plates, in particular the present disclosure relates to ruck plates that are adapted to mitigate existing or potential back problems.

BACKGROUND

Rucking is a form of exercise that involves walking or hiking with a weighted backpack, known as a rucksack or simply a "ruck." It's a versatile and effective way to improve cardiovascular fitness, build strength, and burn calories. The added weight creates resistance, which engages various muscle groups, particularly in the legs, back, and core. Rucking can be adapted to different fitness levels, as the weight and distance can be adjusted to suit a person's capabilities. It's a popular training method among military personnel, but it has gained popularity in the civilian fitness community as well, thanks to its simplicity and effectiveness in achieving a full-body workout. Additionally, rucking offers the added benefit of being a low-impact exercise, making it accessible to a wide range of individuals.

When rucking, a person carries a weighted sack or bag while completing various activities, like running, push-ups, etc. Specially designed rucking articles can be worn like a backpack and include compartments for holding weighted plates, or ruck plates.

A potential issue that can occur because of rucking is the aggravation of back issues. The rucking article and/or ruck plate may agitate a person's back or potentially cause discomfort, or damage. Therefore, there is a need in the field to provide rucking equipment that can mitigate back issues that could arise when rucking.

SUMMARY

The present disclosure is directed to ruck plates that are adapted to mitigate existing or potential back problems during rucking.

An aspect of the present disclosure is a ruck plate. The ruck plate having a front surface having a first side edge, a second side edge, a top edge, and a bottom edge; a back surface located opposite of the front surface, the back surface separated from the front surface by a thickness T1; and a depression formed in the back surface, the depression formed from a first rear side of the back surface and a second rear side of the back surface, wherein each of the first rear side and the second rear side curve inwards towards a planar central portion as the first rear side and the second rear side approach the planar central portion of the back surface.

Another aspect of the present disclosure is a plate for use when rucking. The plate having a front surface having a first side edge, a second side edge, a top edge, and a bottom edge, wherein the first side edge, the second side edge, the top edge, and the bottom edge form a rectangular shape; a back surface located opposite of the front surface, the back surface separated from the front surface by a thickness T1; and a depression formed in the back surface, the depression formed from a first rear side of the back surface and a second rear side of the back surface, wherein each of the first rear side and the second rear side have thicknesses T1, wherein as the first rear side and the second rear side approach the planar central portion of the back surface thickness decreases to a thickness T2.

BRIEF DESCRIPTION OF THE DRAWINGS

The foregoing summary, as well as the following detailed description of illustrative embodiments of the present application, will be better understood when read in conjunction with the appended drawings. For illustrating the present application, shown in the drawings are embodiments of the disclosure. It should be understood, however, that the application is not limited to the precise arrangements and instrumentalities shown.

DETAILED DESCRIPTION OF ILLUSTRATIVE EMBODIMENTS

To facilitate an understanding of embodiments, principles, and features of the present disclosure, they are disclosed hereinafter with reference to implementation in illustrative embodiments. Embodiments of the present disclosure, however, are not limited to use in the described systems or methods and may be utilized in other systems and methods as will be understood by those skilled in the art.

The components described hereinafter as making up the various embodiments are intended to be illustrative and not restrictive. Many suitable components that would perform the same or a similar function as the components described herein are intended to be embraced within the scope of embodiments of the present disclosure.

Embodiments of the present disclosure describe ruck plates and in particular ruck plates that are adapted to mitigate existing or potential harm to a user's back and spine. A ruck plate is a specially designed, typically flat, and dense object, often made of steel or other durable materials, that is used to add weight to a backpack (rucksack) during rucking exercises.

Ruck plates are built for endurance training and are crafted to fit into the dedicated compartments of a rucksack. They provide a balanced and stable distribution of weight, allowing individuals to increase the intensity of their rucking workouts and build strength and endurance. Ruck plates come in various sizes and weights, catering to different fitness levels and goals. They are a popular tool among athletes, military personnel, and fitness enthusiasts seeking an effective and challenging full-body workout.

Figure 1:
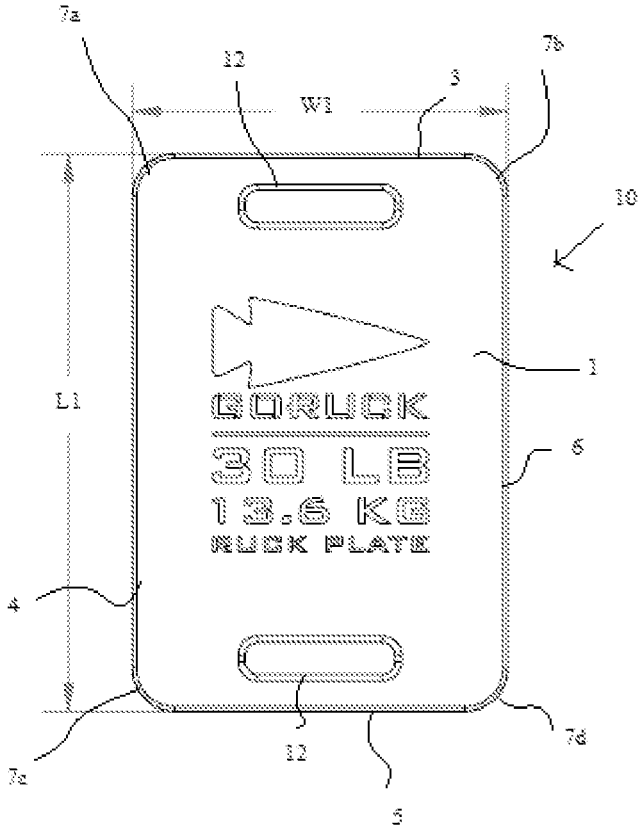
FIG. 1 is a front plan view of a ruck plate according to an embodiment of the present disclosure.

Referring now to FIG. 1, FIG. 1 is a front plan view of a ruck plate 10, according to an embodiment of the present disclosure. The ruck plate 10 comprises a first surface 1. In the embodiment shown in FIG. 1, first surface 1 is the front of the ruck plate 10. The first surface 1 is substantially flat and can have indicia indicating the weight, manufacturer, or other information regarding the ruck plate 10.

The ruck plates 10 disclosed herein may be constructed from various materials to enhance durability and functionality during weighted backpack training. These materials include but are not limited to steel, cast iron, rubber-coated steel, and dense plastics or polymers. Steel plates provide sturdiness and weight, ideal for providing substantial resistance without excessive bulk. Similarly, cast iron plates offer durability and density. Rubber-coated steel plates combine durability with protective features, safeguarding both the plate and backpack. Ruck plates made from dense plastics or polymers offer a lighter alternative while still providing weight for effective training. The selection of material depends on factors such as weight, durability, cost, and environmental resistance, ensuring versatility in meeting diverse user preferences and training requirements. Ruck plates 10 may weigh between 10 lbs. and 50 lbs. In an embodiment, the ruck plate 10 may be 10 lbs. In an embodiment, the ruck plate 10 may be 15 lbs. In an embodiment, the ruck plate 10 may be 20 lbs. In an embodiment, the ruck plate 10 may be 25 lbs. In an embodiment, the ruck plate 10 may be 30 lbs. In an embodiment, the ruck plate 10 may be 35 lbs. In an embodiment, the ruck plate 10 may be 40 lbs. In an embodiment, the ruck plate 10 may be 45 lbs. In an embodiment, the ruck plate 10 may be 50 lbs.

Figure 2:
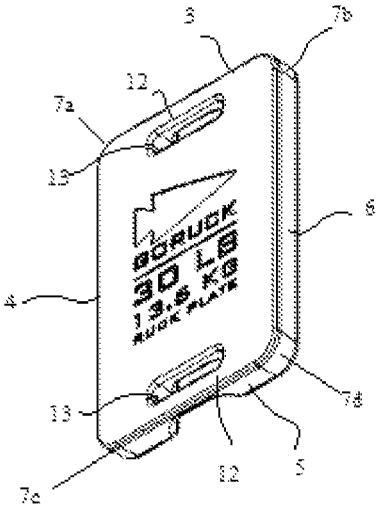
FIG. 2 is perspective view of the ruck plate shown in FIG. 1.

In the embodiment shown in FIGS. 1 and 2, the first surface 1 of the ruck plate 10 has a generally rectangular shape having a top edge 3, a side edge 4, a bottom edge 5, and side edge 6. The top edge 3 and the bottom edge 5 both have a width W1. The side edge 4 and side edge 6 both have a length L1.

In an embodiment, W1 is between 4-10 inches (10.2 cm to 25.4 cm). In an embodiment, W1 is about 9 inches (22.9 cm). In an embodiment, W1 is less than 15 inches (38.1 cm). The width W1 is determined based on the size and weight of the ruck plate 10 that is being used and the ruck sack in which the ruck plate 10 may be placed. Additionally, the width W1 is adapted to accommodate the structure of the ruck plate 10 that helps to mitigate potential damage to a user's back. The width W1 of the ruck plate 10 is large enough to support the curvature of the area that is adapted to accommodate a user's spine.

In an embodiment, L1 is about 12.5 inches (31.75 cm). In an embodiment, L1 is less than 24 inches 61 (cm). In an embodiment, L1 is between 8-14 inches (20.3 cm to 35.6 cm). The length L1 is determined based on the size and weight of the ruck plate 10 that is being used and the ruck sack in which the ruck plate 10 may be placed. Additionally, the length L1 is adapted to accommodate the structure of the ruck plate 10 that helps to mitigate potential damage to a user's back. The length L1 of the ruck plate 10 is large enough to support the curvature of the area that is adapted to accommodate a user's spine.

In the embodiment shown in FIGS. 1 and 2, the first surface 1 has corners 7*a*-7*d*. The corners 7*a*-7*d* are curved. The curvature of the corners 7*a*-7*d* permits the ruck plate 10 to be placed into and out of ruck sacks (not shown) without potentially damaging the interior. The curvature of the corners 7*a*-7*d* also avoids having sharp edges that could potentially cause injury during a rucking exercise or cause damage to a ruck sack.

Figure 3:
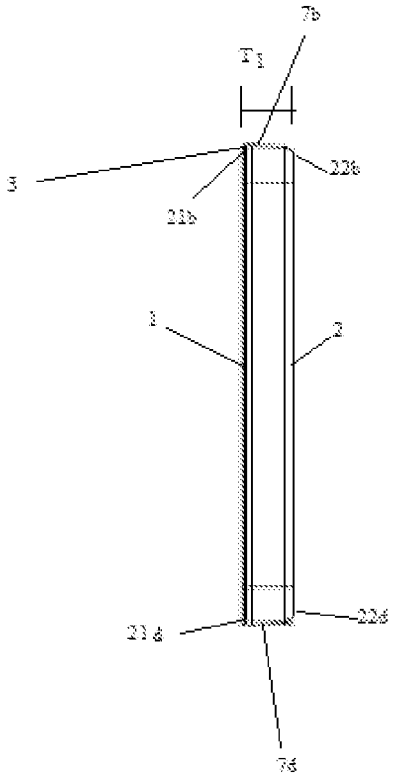
FIG. 3 is a side view of the ruck plate shown in FIG. 1.

With reference to FIGS. 1-3, corners 7*a*-7*d* additionally have a slope as each of the corners 7*a*-7*d* extend toward the back of the ruck plate 10. The slope of the corners 7*a*-7*d* are sloped to accommodate the structure of the backside of the ruck plate 10 that is adapted to mitigate any potential damage or irritation to the back of a user of the ruck plate 10 while rucking.

Generally, the slope of the corners (from front surface 1 to back surface 2) at corners 7*a*-7*d* is gradual and is between 5-15° with respect to the top edge 3 of the ruck plate 10, or bottom edge of the ruck plate 10. The top edge 3 slopes from corner 7*b* shown in FIG. 3 downward from front top corner 21*b* to rear top corner 22*b*. Similarly, the bottom edge 5 slopes from the front bottom corner 21*d* upward towards the rear bottom corner 22*d* (when viewing the ruck plate 10 in an up and down orientation).

The thickness T1 between front surface 1 and the back surface 2 is between 0.5 to 3 inches (1.3 cm to 7.6 cm). In an embodiment, the thickness T1 is between 1 and 2 inches (2.5 cm and 5.1 cm). In another embodiment, the thickness T1 is between 1.1 and 1.4 inches 2.8 cm and 3.5 cm).

While the first surface 1 of the ruck plate 10 generally has a rectangular shape, other shapes are possible that can be used in accordance with the disclosure contained herein. In an embodiment, the shape of the ruck plate is circular, oval shaped, triangular, pentagonal, hexagonal, or another polygonal shape. In an embodiment, the shape of the ruck plate coincides with the shape of the ruck sack in which the ruck plate is placed. It should be understood that the general overall shape may be modified in accordance with this disclosure, provided the shape of the portions of the ruck plate 10 adapted to mitigate potential harm to a user's back/and or spine are able to perform their respective functions.

Referring to FIGS. 1 and 2, the ruck plate 10 has a handle 12 that is formed by the presence of an oval shaped cutout 13 in the first surface 1 that extends through to the second surface 2. The handle 12 permits a person to easily grab and move the ruck plate 10. In the embodiment, shown in FIGS. 1 and 2, there are two handles 12, one located near the top edge 3 of the ruck plate 10 and one located near the bottom edge 5 of the ruck plate 10. Having two handles 12 permits the ruck plate 10 to be grabbed and held from the top edge 3 or bottom edge 5.

Figure 4:
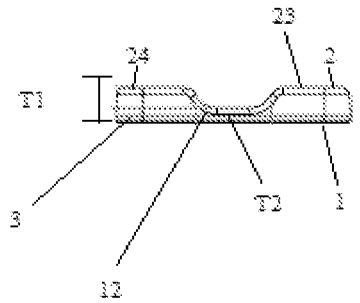
FIG. 4 is a top view of the ruck plate shown in FIG. 1.
Figure 5:
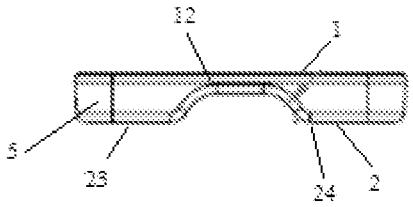
FIG. 5 is a bottom view of the ruck article shown in FIG. 1.
Figure 6:
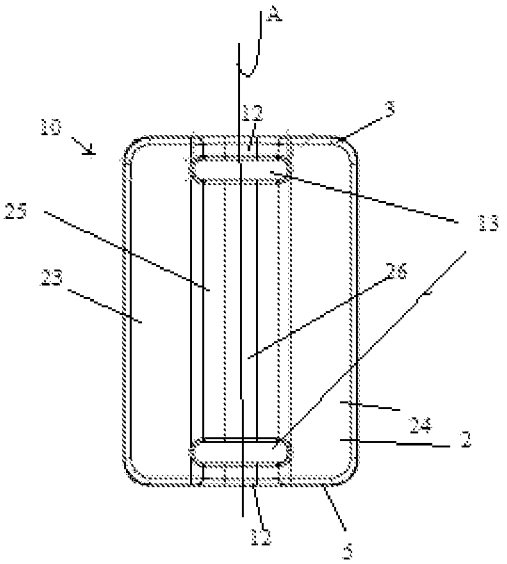
FIG. 6 is a rear view of the ruck plate shown in FIG. 1.
Figure 7:
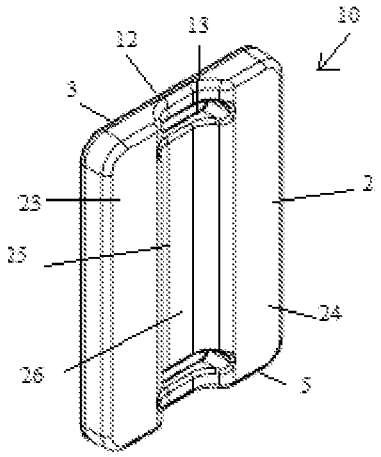
FIG. 7 is rear perspective view of the ruck plate shown in FIG. 1.

Referring now to FIGS. 4-7, FIG. 4 shows a top-down view of the ruck plate 10 shown in FIG. 1. FIG. 5 is a bottom-up view of the ruck plate 10 shown in FIG. 1. The views of the ruck plate 10 shown in FIG. 4 and FIG. 5 show the curvature of the rear surface 2 of the ruck plate 10. FIG. 6 shows a rear view of the ruck plate 10. FIG. 7 shows a perspective rear view of the ruck plate 10.

The back surface 2 is shaped to accommodate a person's spine to mitigate the possibility of back or spine injury. The back surface 2 has a depression 25 formed therein. The depression 25 is formed by first rear side 23 and second rear side 24 curving towards the center axis A of the ruck plate 10. The depression 25 extends from the top edge 3 to the bottom edge 5, with the curved portions of the first rear side 23 and the second rear side 24 extending the entire length of the of the ruck plate 10.

The depression 25 further accommodates the handles 12 formed in the ruck plate 10. The curvature of the depression 25 has a generally U-shaped cross-section, or parentheses shaped cross-section. Each side is planar as it approaches the center axis A and gradually curves down to the planar central portion 26 of the depression 25. In an embodiment, the curvature of each of the sides is generally smooth. In an embodiment, the curvature of each of the sides changes as it moves towards the central portion 26 of the ruck plate 10.

The thickness T1 of the ruck plate 10 changes as the first rear side 23 and the second rear side 24 approach the planar central portion 26. The thickness T1 is greater towards the side edge 4 and the side edge 6 than at the flattened central portion 26, where there is a thickness T2. Thus, the thickness T1 is generally greater than the thickness T2.

The depression 25 with the planar central portion 26 accommodates the movement of a person's spine and back area when rucking. This prevents the spine and back area from being damaged by rucking movement or when using the ruck plate 10 for other types of exercise.

In an embodiment, the depression 25 has padding. In an embodiment, the depression 25 is coated in fabric. In an embodiment, the depression 25 has a layer of pliable material. In an embodiment, a rubber or polyurethane coating is placed in the depression 25 of the ruck plate 10. In an embodiment a rubber or polyurethane coating is placed on the flattened central portion 26 of the ruck plate 10. A soft rubber or polyurethane coating on metal plates provides a cushioning effect, reducing the risk of injuries. In an embodiment a neoprene coating may be used to provide resistance to abrasion. In an embodiment, a vinyl coating may be used to provide a soft and smooth texture. In an embodiment, a urethane coating can be used to provide durability and flexibility. In an embodiment, a HDPE (High-Density Polyethylene) can be used. In an embodiment foam padding can be used. In an embodiment, a silicone coating can be used. In an embodiment, a nitrile coating can be used to provide a soft and flexible layer.

Figure 8:
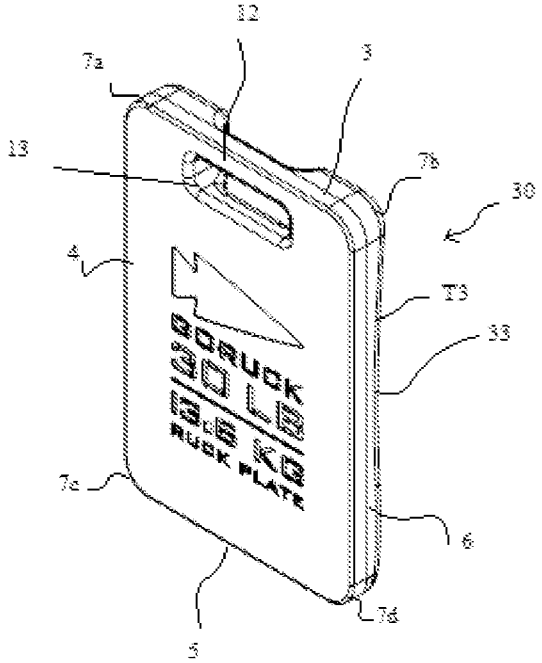
FIG. 8 is a perspective view of an embodiment of a ruck plate.
Figure 9:
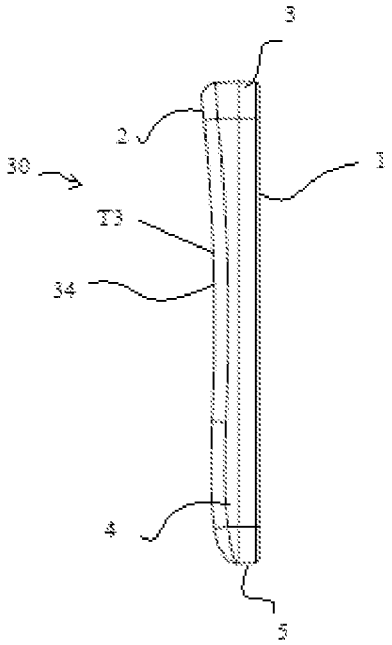
FIG. 9 is a side view of the ruck plate shown in FIG. 8.
Figure 10:
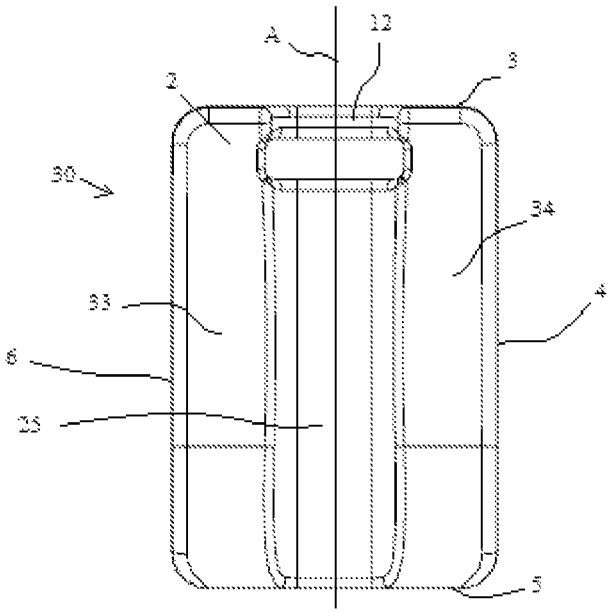
FIG. 10 is a rear view of the ruck plate shown in FIG. 8.

Turning to FIGS. 8-10, shown is an embodiment of a ruck plate 30 that has additional curvature on the back surface 2. The additional curvature on the back surface 2 is provided to accommodate the general shape of a person's back, such as the areas proximate to the spine.

The back surface 2 has a depression 25 formed therein. The depression 25 is formed by curved first rear side 33 and curved second rear side 34 in the same manner as first rear side 23 and second rear side 24 for the depression 25, discussed above. The lateral portions of the curved first rear side 33 and the curved second rear side 34 curve towards the center axis A of the ruck plate 30 forming the depression 25. The depression 25 extends from the top edge 3 to the bottom edge 5, with the curved portions of the curved first rear side 33 and the curved second rear side 34 extending the entire length of the of the ruck plate 30.

Additionally, the curved first rear side 33 and the curved second rear side 34 have curved surfaces that are shaped to accommodate the curvature of a person's back in those areas that are proximate to a person's spine. Both the curved first rear side 33 and the curved second rear side 34 curve inwards as the curved first rear side 33 and the curved second rear side 34 extend from the top edge 3 to the middle portion of the back surface 2. Both the curved first rear side 33 and the curved second rear side 34 curve inwards, for a majority of the distance, as the curved first rear side 33 and the curved second rear side 34 extend from the bottom edge 5 to the middle portion of the back surface 2. The curvature formed by the curved first rear side 33 and the curved second rear side 34 is not as pronounced as the depression 25. In an embodiment, the curvature of curved first rear side 33 and the curved second rear side 34 changes as it moves from the top edge 3 to the bottom edge 5 of the ruck plate 30.

The thickness T3 of the ruck plate 30 changes as the curved first rear side 33 and the curved second rear side 34 extends from the top edge 3 to the bottom edge 5. The thickness T3 is greater towards the top edge 3 and the bottom edge 5, where there is a thickness T1. Thus, the thickness T1 is generally greater than the thickness T3.

Still referring to FIGS. 8-10, the depression 25 further accommodates the handle 12 formed in the ruck plate 30. The curvature of the depression 25 has a generally U-shaped cross-section, or parentheses shaped cross-section.

The depression 25, curved first rear side 33, and curved second rear side 34 accommodates the movement of a person's spine and back area when rucking. This prevents the spine and back area from being damaged by rucking movement or when using the ruck plate 30 for other types of exercise.

Wherever possible, the same or like reference numbers are used throughout the drawings to refer to the same or like features. It should be noted that the drawings are in simplified schematic form and are not drawn to precise scale. Certain terminology is used in the description is for convenience only and is not limiting. Directional terms such as top, bottom, left, right, above, below and diagonal, are used with respect to the accompanying drawings. The words "inwardly" and "outwardly" refer to directions toward and away from, respectively, the geometric center of the identified element and designated parts thereof. Such directional terms used in conjunction with the following description of the drawings should not be construed to limit the scope of the present disclosure in any manner not explicitly set forth. Additionally, the term "a," as used in the specification, means "at least one." The terminology includes the words above specifically mentioned, derivatives thereof, and words of similar import.

"Substantially" as used herein shall mean considerable in extent, largely but not wholly that which is specified, or an appropriate variation therefrom as is acceptable within the field of art. "Exemplary" as used herein shall mean serving as an example.

"About" as used herein when referring to a measurable value such as an amount, a temporal duration, and the like, is meant to encompass variations of ±20%, ±10%, ±5%, ±1%, or ±0.1% from the specified value, as such variations are appropriate.

Throughout this disclosure, various embodiments of the present invention can be presented in a range format. It should be understood that the description in range format is merely for convenience and brevity and should not be construed as an inflexible limitation on the scope of the present invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of exemplary embodiments may be combined in any suitable manner in one or more embodiments. One skilled in the art will recognize, in light of the description herein, that the exemplary embodiments can be practiced without one or more of the specific features or advantages of a particular embodiment. In other instances, additional features and advantages may be recognized in certain embodiments that may not be present in all embodiments of the present disclosure.

While the disclosure is described herein, using a limited number of embodiments, these specific embodiments are not intended to limit the scope of the disclosure as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in an order as desired.

The invention claimed is:

1. A ruck plate comprising:

a front surface having a first side edge, a second side edge, a top edge, and a bottom edge;

a back surface located opposite of the front surface, the back surface separated from the front surface by a thickness T1; and a depression formed in the back surface, the depression formed from a first rear side of the back surface and a second rear side of the back surface, wherein each of the first rear side and the second rear side curve inwards towards a planar central portion as the first rear side and the second rear side approach the planar central portion of the back surface, wherein a first portion of the depression is formed in the top edge, wherein a second portion of the depression is formed in the bottom edge, and wherein the depression non-continuously extends an entire length of the back surface.

2. The ruck plate of claim 1, wherein the thickness T1 of the first rear side is different closer to the first side edge than a thickness T2 proximate to the planar central portion.

3. The ruck plate of claim 1, wherein a cross-sectional view of the depression is U-shaped.

4. The ruck plate of claim 1, wherein at least one handle is formed by a cutout that extends from the front surface to the back surface.

5. The ruck plate of claim 4, wherein the at least one handle is formed by the first rear side of the back surface and the second rear side of the back surface curving inwards towards the planar central portion of the back surface.

6. The ruck plate of claim 1, wherein the first rear side and the second rear side each have surfaces that curve as the first rear side and the second rear side extend from the top edge to the bottom edge.

7. The ruck plate of claim 1, wherein corners are formed between the front surface and the rear surface, wherein the corners are sloped as the corners extend between the front surface and the rear surface.

8. A plate for use when rucking comprising:

a front surface having a first side edge, a second side edge, a top edge and a bottom edge, wherein the first side edge, the second side edge, the top edge and the bottom edge form a rectangular shape;

a back surface located opposite of the front surface, the back surface separated from the front surface by a thickness T1; and a depression formed in the back surface, the depression formed from a first rear side of the back surface and a second rear side of the back surface, wherein each of the first rear side and the second rear side have thicknesses T1, wherein as the first rear side and the second rear side approach the planar central portion of the back surface thickness decreases to a thickness T2, wherein a first portion of the depression is formed in the top edge, wherein a second portion of the depression is formed in the bottom edge, and wherein the depression non-continuously extends an entire length of the back surface.

9. The plate for use when rucking of claim 8, wherein the thickness T2 of the planar central portion is constant.

10. The plate for use when rucking of claim 8, wherein a cross-sectional view of the depression is U-shaped.

11. The plate for use when rucking of claim 8, wherein at least one handle is formed by a cutout that extends from the front surface to the back surface.

12. The plate for use when rucking of claim 11, wherein the at least one handle is formed by the first rear side of the back surface and the second rear side of the back surface curving inwards towards the planar central portion of the back surface.

13. The plate for use when rucking of claim 8, wherein the first rear side and the second rear side each have surfaces that curve as the first rear side and the second rear side extend from the top edge to the bottom edge.

14. The plate for use when rucking of claim 8, wherein corners are formed between the front surface and the rear surface, wherein the corners are sloped as the corners extend between the front surface and the rear surface.

* * * * *